US005506612A

United States Patent [19]

Ogata et al.

[11] Patent Number: 5,506,612

[45] Date of Patent: Apr. 9, 1996

[54] LED HEAD

[75] Inventors: Hiromi Ogata; Hideharu Hamada; Manabu Yokoyama; Masaya Imamura, all of Kyoto, Japan

[73] Assignee: Rohm Co., Ltd., Kyoto, Japan

[21] Appl. No.: 929,009

[22] Filed: Aug. 13, 1992

[30] Foreign Application Priority Data

Sep. 30, 1991 [JP] Japan ..... 3-250036
Sep. 30, 1991 [JP] Japan ..... 3-250040

[51] Int. Cl.[6] ..... B41J 2/385; B41J 2/435

[52] U.S. Cl. ..... 347/138; 347/245; 347/248

[58] Field of Search ..... 346/107 R, 150, 346/154, 155, 160, 139 R, 138; 24/458, 530, 546, 555; 347/138, 245, 238

[56] References Cited

U.S. PATENT DOCUMENTS 4,703,334 10/1987 Mochimaru et al. ..... 346/160
4,904,862 2/1990 Bertagne ..... 346/155 X
5,014,074 5/1991 Dody et al. ..... 346/107 R
5,099,550 3/1992 Beane et al. ..... 24/555
5,235,348 8/1993 Avonts ..... 346/107 R
5,357,404 10/1994 Bright et al. ..... 24/458 X

*Primary Examiner*—Benjamin R. Fuller
*Assistant Examiner*—David Yockey
*Attorney, Agent, or Firm*—Fish & Richardson

[57] ABSTRACT

In an LED head, a photosensitive drum is positioned with reference to an upper surface of a circuit board on which surface at least one light-emitting element is supported in order to accurately set the distance between the light-emitting element and a photosensitive drum. Further, clips and a spring are used to accurately set the distance between the light-emitting element and a lens and to simplify the process of production.

25 Claims, 6 Drawing Sheets

LED HEAD

BACKGROUND OF THE INVENTION

1. Field of the Invention

This invention relates to an LED head for forming a dot on a photosensitive drum by focusing a light beam from a row of light-emitting elements at a predetermined position by a condenser lens, and more particularly to an arrangement for setting a distance between the row of light-emitting elements and the photosensitive drum and for securing a positional relationship between the row of light-emitting elements and the condenser lens.

2. Description of Related Art

An LED printer is a printer for printing an image formed on a photosensitive drum by an LED head. The LED head is a head which comprises a plurality of light-emitting diodes arranged in a row and a condenser lens disposed between the row of light-emitting diodes and the photosensitive drum. The condenser lens converges a light beam from the row of light-emitting diodes to focus it on the surface of the photosensitive drum. If the row of light-emitting diodes, the condenser lens and the photosensitive drum are positioned in a precise arrangement, it is possible to achieve a good printing quality.

FIG. 8 of the accompanying drawings is a schematic side view of a focusing mechanism for setting the distance between a row of light-emitting diodes and a photosensitive drum 14 to a predetermined value, illustrating a typical conventional LED head.

The row of light-emitting diodes and an integrated circuit for activating it are supported on a circuit board 10. In FIG. 8, parts or elements on the circuit board 10 are not seen as they are covered by a head cover 16 (described below). A condenser lens row 12 is disposed between the light-emitting-diode-row-supporting surface of the circuit board 10 and the photosensitive drum 14. The condenser lens row 12 includes a plurality of condenser lenses formed as a unit in association with the individual light-emitting diodes for focusing an output light beam of each light-emitting diode onto the surface of the photosensitive drum 14. The head cover 16 is mounted on the light-emitting-diode-row-supporting surface of the circuit board 10, covering the row of light-emitting diodes. The condenser lens row 12 is fixed to the upper surface of the head cover 16, so the head cover 16 serves to set the distance between the circuit board 10 and the condenser lens row 12 to a predetermined value.

A heat-radiating plate 18 is attached to the lower surface of the circuit board 10. The heat-radiating plate 18 serves to assist in removing heat generated by parts or elements on the circuit board 10 and constitutes a positioning mechanism 20 for positioning the light-emitting diode row with respect to the photosensitive drum 14. The positioning mechanism 20 includes a pin 22 projecting from the heat-radiating plate 18, and a support post 24 leading from one end surface of the photosensitive drum 14 and having in one end a recess 26 engageable with a distal end of the pin 22.

In this conventional arrangement, the distance between the circuit board 10 supporting the light-emitting diode row and the photosensitive drum 14 is set with the upper surface of the heat-radiating plate 18 as a reference surface. In this case, the varying thickness of the circuit board 10 would be the cause for reduced precision in the distance between the circuit board 10 and the photosensitive drum 14.

FIG. 9 is a schematic side view of another conventional LED head having a positioning mechanism 28 different from that of FIG. 8. In FIG. 9, parts or elements similar to those of FIG. 8 are designated by like reference numerals.

In this positioning mechanism 28, the upper surface of a head cover 30 is a reference surface. The head cover 30 and the circuit board 32 extend toward and terminate immediately short of one end of the heat-radiating plate 18, and the head cover 30 has in its upper surface a recess 34. A support post 36 leading from the end surface of the head cover 30 has a rounded distal end engageable with the recess 30.

This arrangement causes the same problem as with other conventional art. Namely, since the reference surface is the upper surface of the head cover, the varying thickness of the head cover 30 would cause reduced precision in the distance between the circuit board 32 and the photosensitive drum 14.

Another problem of the conventional art is that the precision in relative position of the light-emitting diode row and the condenser lens row would also be deteriorated.

FIG. 10 is an exploded perspective view of another LED head illustrating the last-mentioned problem. In FIG. 10, the parts or elements similar to those of FIG. 8 are designated by like reference numerals. Assuming that the positional relationship between the light-emitting diode row arranged on the circuit board 10 and the condenser lens row 12 fixed on the head cover 16 is determined properly, light emitted from the individual light-emitting diode will be focused correctly on the photosensitive drum by the corresponding condenser lens. In the conventional art, the positional precision is secured by means of a reference pin 38 and a through-hole 40. The reference pin 38 is projecting from the lower surface of the head cover 16, and the through-hole 40 is formed in the circuit board 10. As the reference pin 38 is inserted into the through-hole 40, the positional relationship between the head cover 16 and the circuit board 10 and thus between the condenser lens row 12 and the light-emitting diode row can be determined precisely.

With this conventional art, since the reference pin 38 and the through-hole 40 are needed to secure a precise positional relationship between the light-emitting diode row and the condenser lens row 12, it is inevitable that the process of production would be complex and hence the cost of production would be increased.

SUMMARY OF THE INVENTION

A first object of this invention is to provide an LED head which can improve the degree of precision in distance between a light-emitting element row and a photosensitive drum.

A second object of the invention Is to provide an LED head which can secure a precise position relationship between a light-emitting element row and a condenser lens row without making the production process complex and increasing the cost of production.

According to a first embodiment of the invention, an LED head comprises:

(a) means for emitting light;

(b) a lens for focusing the light from the light-emitting means upon a surface of a photosensitive member; and (c) means for setting a predetermined distance between the light-emitting means and the photosensitive member;

(d) the setting means including (1) a circuit board supporting on its surface the light-emitting means, and (2) means for positioning the photosensitive member, with respect to the light-emitting means, with the light-emitting-means-supporting surface of the circuit board as a reference surface.

According to a second embodiment of the invention, an LED head comprises:

(a) means for emitting light;

(b) a lens for focusing the light from the light-emitting means upon a surface of a photosensitive member; and (c) means for securing a positional relationship between the light-emitting means and the lens;

(d) the securing position including (1) a circuit board supporting the light-emitting means on its surface, (2) a cover covering the light-emitting means in such a manner that the light emitted from the light-emitting means fails onto the lens, and (3) a clamp for clamping the cover against the circuit board.

According to a third embodiment of the invention, an LED head comprises:

(a) means for emitting light;

(b) a lens for focusing the light from the light-emitting means upon a surface of a photosensitive member;

(c) a circuit board supporting the light-emitting means on its surface;

(d) a cover covering the light-emitting means in such a manner that the light emitted from the light-emitting means falls onto the lens;

(e) means for positioning the photosensitive member, with respect to the light-emitting means, with the light-emitting-means-supporting surface of the circuit board as a reference surface; and (f) a clamp for clamping the cover against the circuit board.

An LED printer using one of the foregoing LED head can be realized. In this case, the LED head also has a photosensitive to member. This invention can also be considered a mechanism for setting the distance between the light-emitting means and the photosensitive member to a predetermined value or as a mechanism for securing a positional relationship between the light-emitting means and the lens.

With the first arrangement, the distance between the light-emitting means and the photosensitive member can be precisely determined with the light-emitting-means-supporting surface of the circuit board as a reference surface, irrespective of the thickness of the circuit board. With the second arrangement, partly since the lens is held by the cover and partly since the cover is clamped against the circuit board, it is possible to simplify the process of production as well as to secure a precise positional relationship between the lens and the light-emitting means, without using the conventional means such as a pin and a hole. With the third arrangement, a combined result of the first and second arrangement can be obtained.

The common feature of the first through third arrangements is as follows. The photosensitive member may be a photosensitive drum. The light-emitting means may include a predetermined number of light-emitting elements such as LEDs. Preferably the LED head is provided with a heat-radiating plate or the like for removing heat of the light-emitting means and other parts therearound. Alternatively the cover may also have the function of a heat-radiating plate.

The common feature of the first and third arrangements is as follows. The positioning means may include a hole formed in the circuit board and a rod-like member extending from the photosensitive member and terminating in a distal end to be inserted in the hole. The rod-like member has at a periphery of the distal end an enlarged-diameter portion contactable with the circuit board. The enlarged-diameter portion serves to restrict the forward longitudinal movement of the rod-like member with respect to the circuit board.

The circuit board may extend longitudinally through the LED head so as to project from opposite ends of the LED head. The hole may be formed in at least one of the projected ends of the circuit board, and a cutout may be formed in the other projected end. Therefore it is possible to realize the positioning means by a very simple structure as well as to secure a certain amount of play when the LED head is attached to the photosensitive drum of an LED printer. The projected portions of the circuit board should preferably be sealed such as with resin.

The common feature of the second and third arrangement is as follows. The clamp may be a resilient member. For example, the resilient member may be a leaf spring bent in a V shape, each of two arms of the V-shape leaf spring having a bent distal end. In this case, the cover should have a first hook engageable with the bent distal end of one arm, and a second hook against which the bent distal end of the other arm is positioned. As the first and second hooks engage the respective arms of the V-shape leaf spring, the resilient member can be positioned with respect to the cover. Further as the circuit board is pressed by the corner of the bent arm, the cover can be restricted In its vertical movement with respect to the circuit board.

Furthermore, one of the two arms of the resilient member may have a pressing portion for pressing the circuit board laterally against the cover. This pressing portion may be a leaf spring bent inwardly from one arm of the V-shape resilient member.

In addition, the cover may have a projection such as a third hook against which the lens is clamped by clips, the projection extending from the light-emitting-means-supporting surface of the circuit board. In this case, the projection may be disposed at the peripheral edge of the hole of the cover and serves to assist in inserting the lens into the hole.

Figure 4:
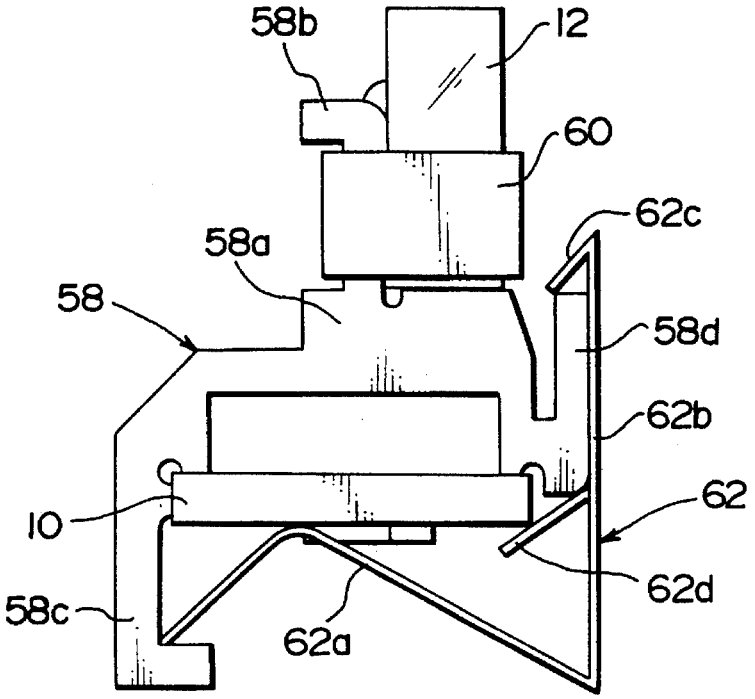
FIG. 4 is a schematic end view of another modified LED head according to a third embodiment.
Figure 7:
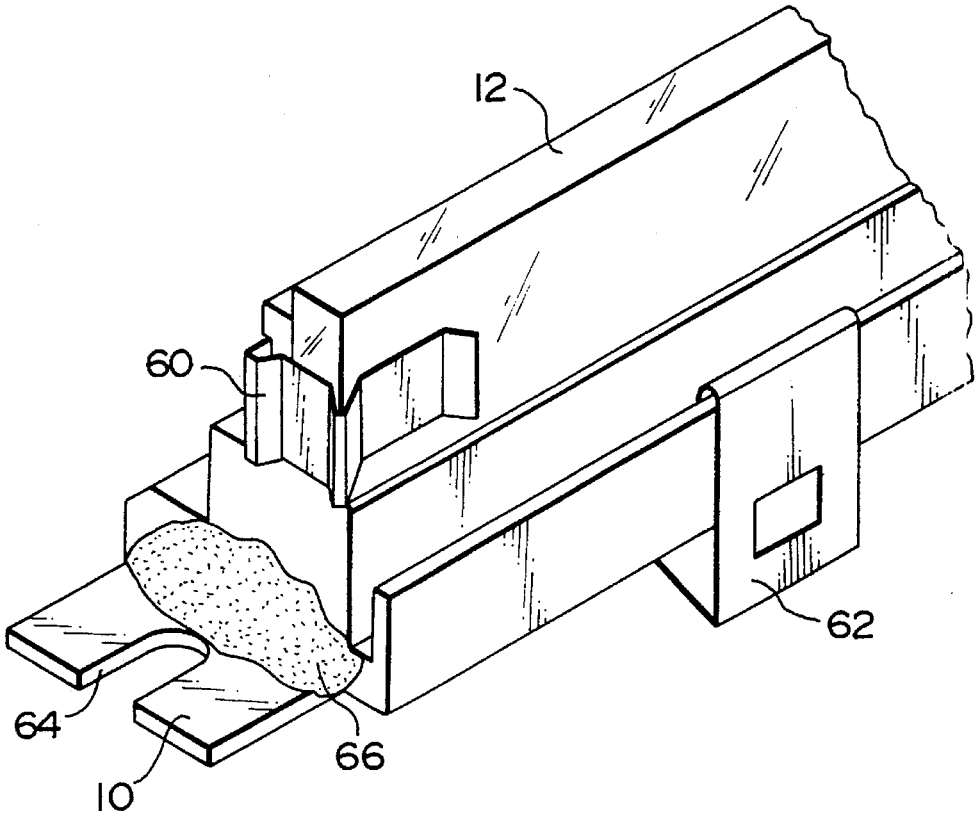
Figure 8:
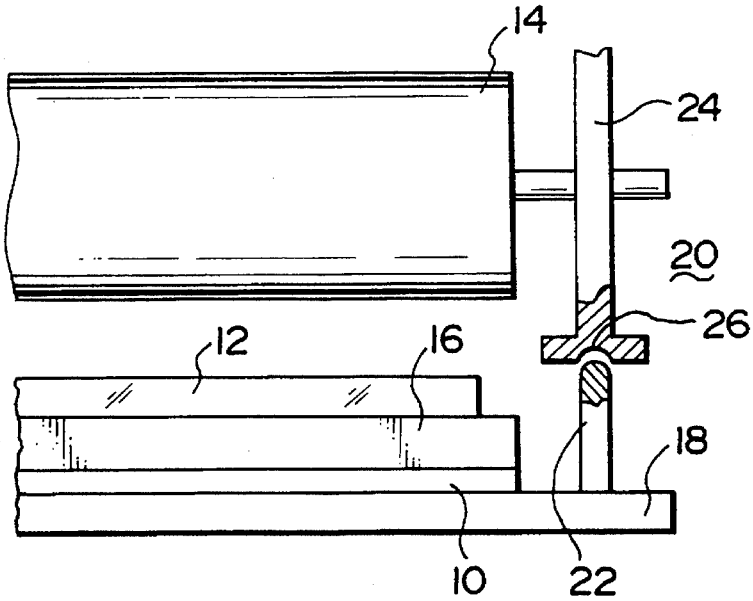
FIG. 8 PRIOR ART
Figure 9:
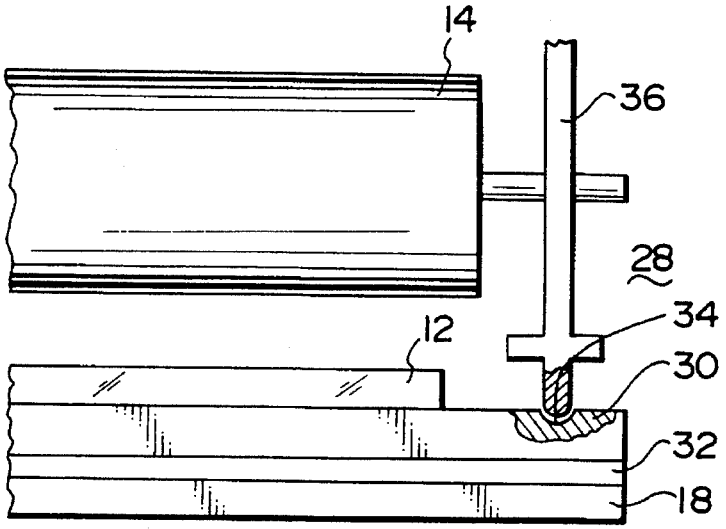
FIG. 9 PRIOR ART
Figure 10:
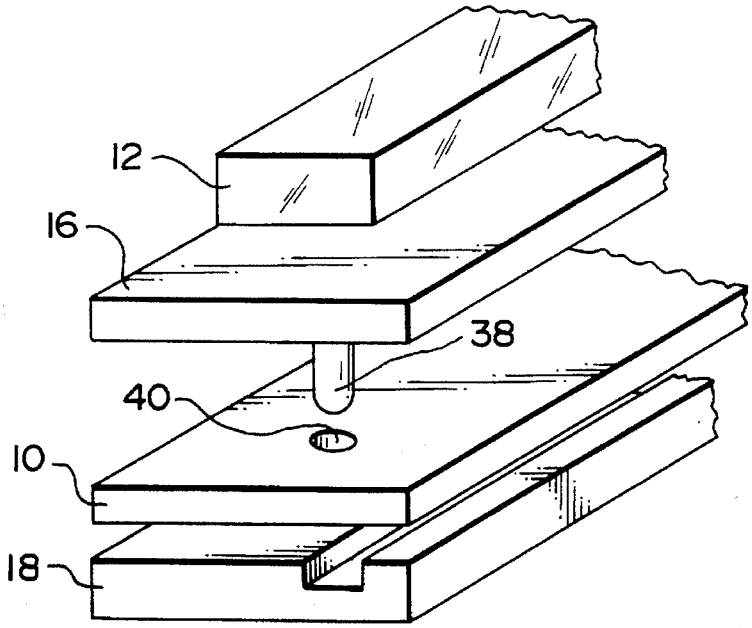
FIG. 10 PRIOR ART

FIGS. *6a* through *6c* are a plan view, a front view and a bottom view, respectively, of FIG. 4;

FIG. 7 is a fragmentary schematic perspective view, on an enlarged scale, of FIG. 4;

FIG. 8 is a fragmentary schematic side view of a first conventional LED head;

FIG. 9 is a fragmentary schematic side view of a second conventional LED head; and FIG. 10 is a fragmentary schematic side view of a third conventional LED head.

DETAILED DESCRIPTION OF THE INVENTION

Several embodiments of this invention will be described with reference to the accompanying drawings. Parts or elements similar to those of the conventional art of FIGS. 8 through 10 are designated by like reference numerals, and their descriptions are omitted to avoid repetition.

Figure 1:
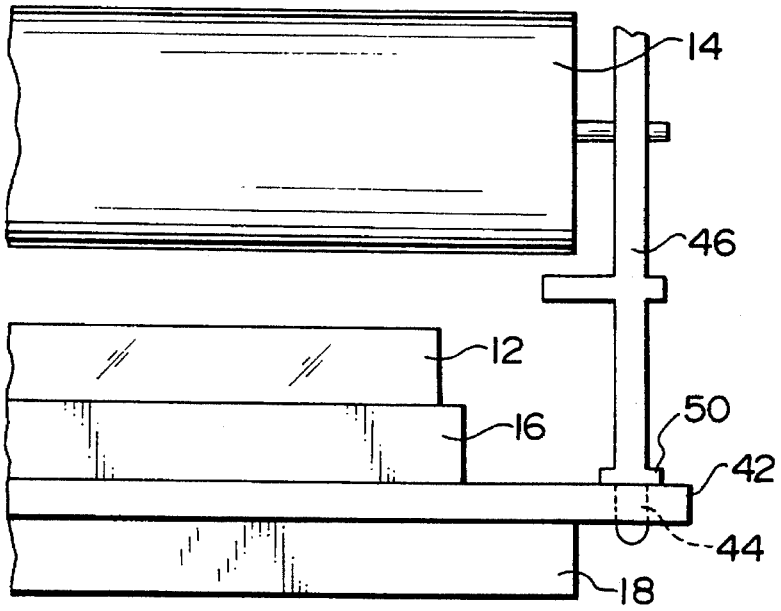
FIG. 1 is a fragmentary schematic side view of an LED head according to a first embodiment of this invention.

FIG. 1 shows an LED head according to a first embodiment of this invention. In this embodiment, a circuit board 42 supporting on Its upper surface a light-emitting diode row and an integrated circuit for activating the light-emitting diode row extends so as to project beyond opposite ends of a heat-radiating plate 18. The circuit board 42 extends parallel to the axis of a photosensitive drum 14 and has in one end a through-hole 44, in which a supporting rod 46 leading from one end of the photosensitive drum 14 is inserted.

Figure 2:
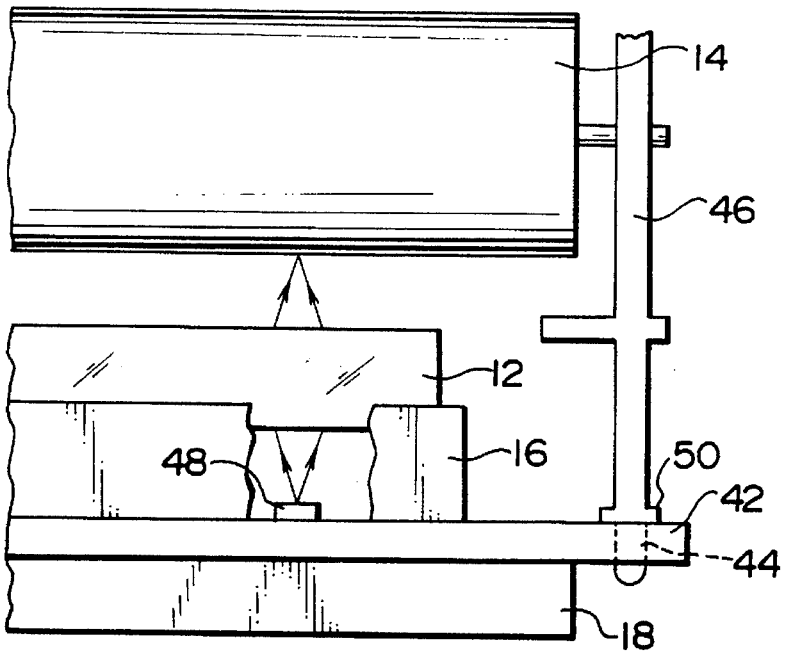
FIG. 2 is a schematic side view, with parts broken away, of the LED head of FIG. 1, illustrating how the LED head operates.

FIG. 2 shows the focusing action in the first embodiment. The individual light-emitting diodes 48 (only one shown) of the light-emitting diode row are supported on the upper surface of the circuit board 42. When a light beam is emitted from the light-emitting diode 48 covered by a head cover 16, this light beam falls on a condenser lens row 12 from a window in an upper surface of the head cover 16 and converges on the peripheral surface of the photosensitive drum 14. The condenser lens may be a self-focusing lens.

The supporting rod post 46 has an enlarged-diameter portion 50 whose lower surface is in contact with the upper surface of the circuit board 42, so that the upper, surface of the circuit board 42 serves as a reference surface to adjust the distance between the photosensitive drum 14 and the light-emitting diode 48. The upper surface of the circuit board 42 is a surface supporting the light-emitting diodes 48. With this arrangement, it is possible to set the distance between the photosensitive drum 14 and the light-emitting diodes 48 accurately as compared to the first and second conventional LED heads.

Figure 3:
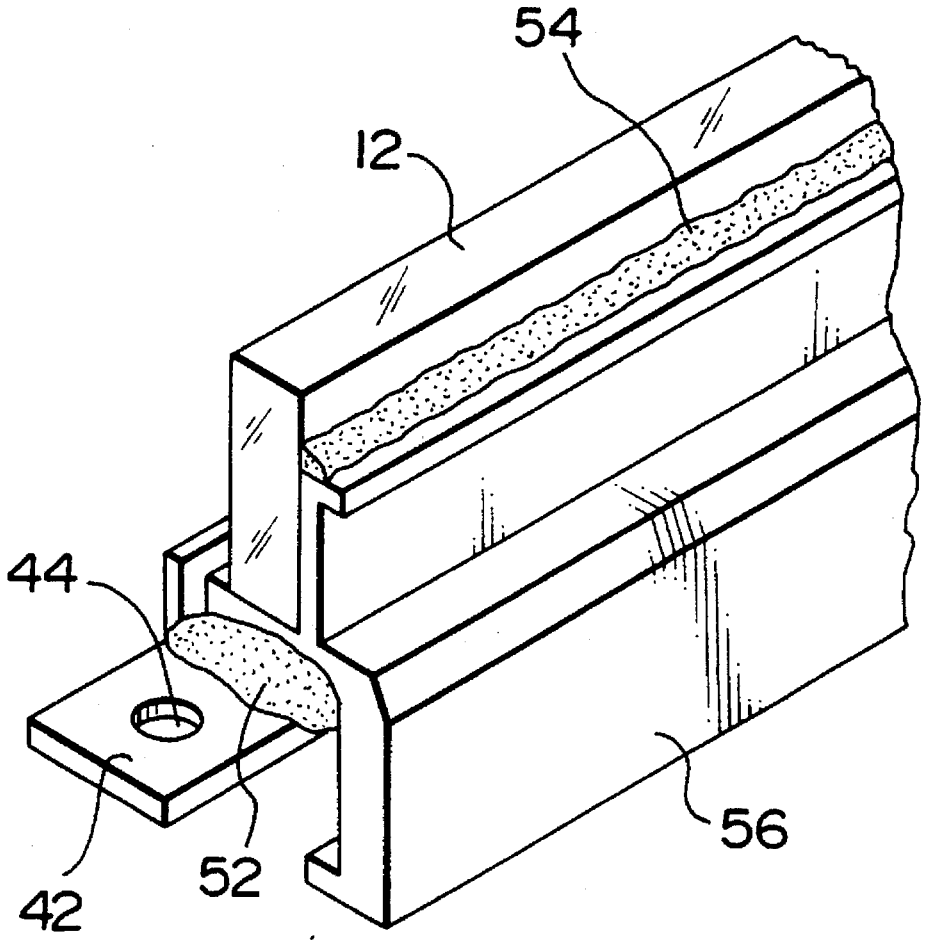
FIG. 3 is a fragmentary schematic perspective view of a modified LED head according to a second embodiment.

FIG. 3 shows a modified LED head according to a second embodiment. Parts or elements similar to those of the first embodiment are designated by like reference numerals. In FIG. 3, 52 designates an adhesive resin attaching the circuit board 42 to a heat-radiating head cover 56, and 54 designates an adhesive resin attaching the heat-radiating head cover to the condenser lens row 12. The photosensitive drum 14 and the supporting rod 46 are omitted in FIG. 3.

This embodiment is different from the second embodiment in that the light-emitting diodes 48 arranged on the circuit board 42 are covered by a heat-radiating head cover 56 and the condenser lens row 12 is attached to the heat-radiating head cover 56. Thus the heat-radiating head cover 56 serves as both a heat-radiating plate and a head cover. The light-emitting diodes 48 are not seen as they are covered by the heat-radiating head cover 56.

In FIG. 3, the heat-radiating plate 56 has a window (not shown) so that the light beams can pass between the light-emitting diodes 48 and the condenser lens row 12. The light beam emitted from the individual light-emitting diode 48 falls on the corresponding condenser lens of the condenser lens row 12 via this window.

In this embodiment, partly since the circuit board 42 extends longitudinally along the rotary photosensitive drum 14 so as to project beyond its opposite ends, and partly since at least one of the projected ends of the circuit board 42 has a through-hole 44, it is possible to improve the precision in distance between the light-emitting diodes 48 and the photosensitive drum 14.

FIG. 4 shows another modified LED head according to a third embodiment. Parts or elements similar to those of the conventional art shown in FIG. 10 as well as to those of the foregoing embodiments shown in FIGS. 1 through 3 are designated by like reference numerals.

A heat-radiating head cover 58 is made from a high-thermal-conductivity material such as aluminum and, like that of the second embodiment, serves as both a head cover and a heat-radiating plate. For the positioning purpose described below, the condenser lens row 12, the heat-radiating head cover 58 and the circuit board 10 are clamped in a unitary form by clamps 60, 62.

In FIG. 4, a flat upper portion **58*a* of the heat-radiating head cover 58 has an opening (not shown) in which the condenser lens 12 is inserted. This opening is in the form of a groove extending longitudinally (depthwise of the sheet of the drawing) of the LED head. The heat-radiating head cover 58 has a hook 58*b* extending upwardly from the flat portion 58*a*. The distal end of the hook 58*b* is bent at a right angle leftwardly in FIG. 4**.

The clamp 60 is fitted around the hook **58*b*. The condenser lens row 12 inserted into the groove attached to the hook 58*b* by the clamp 60. The clamp 60 is a resilient member or clip having a generally M-shape cross section; the two legs of the M shape clamp the condenser lens row 12 and the hook 58*b***.

On the other hand, the heat-radiating head cover 58 also has a hook **58*c* extending downwardly from the left lower end of the cover 58 and terminating in a substantially perpendicularly inwardly bent end. The heat-radiating head cover 58 further has a hook 58*d* extending upwardly from the right upper end of the cover 58. The clamp 62 is a resilient member engageable with the hooks 58*c*, 58*d*, thereby attaching the heat-radiating head cover 58 to the circuit board 10**.

Figure 5:
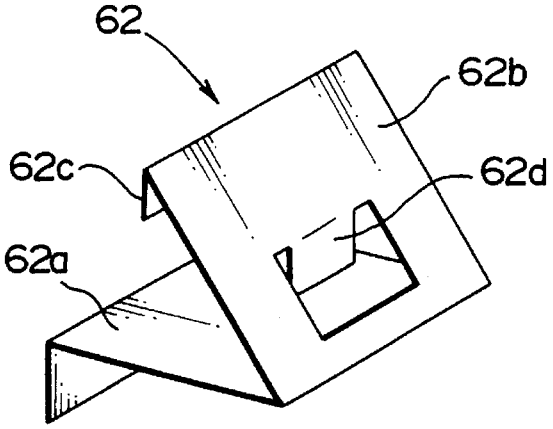
FIG. 5 is a perspective view of an attachment spring used In the third embodiment of FIG. 4.
Figure 6A:
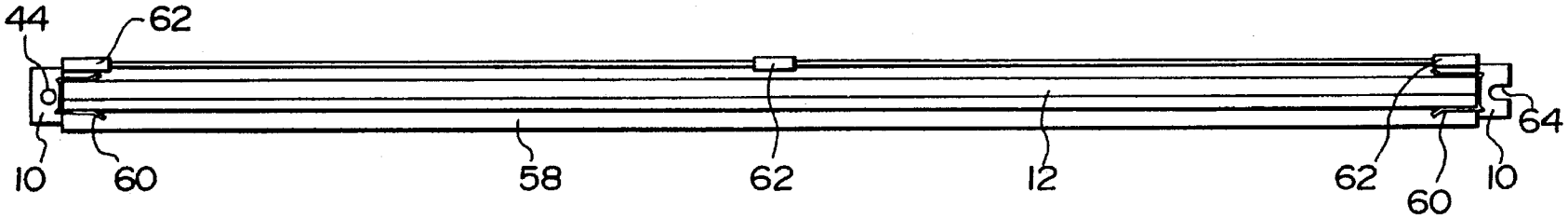
Figure 6B:
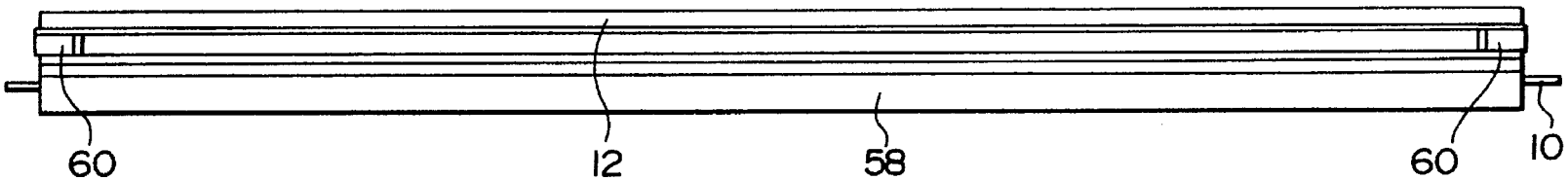
Figure 6C:
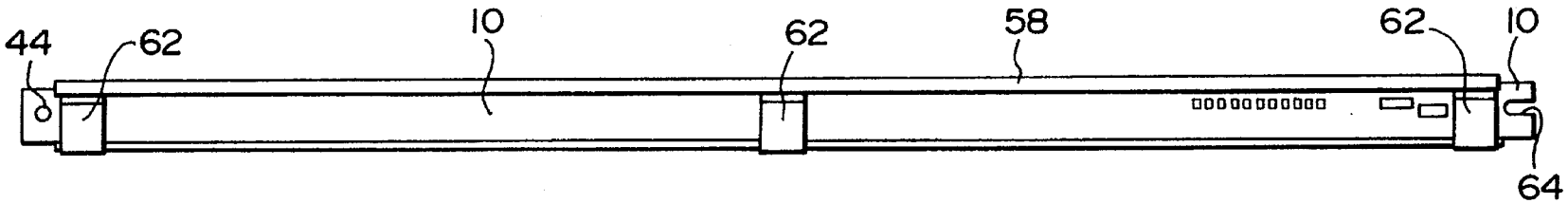

FIG. 5 is a perspective view showing a detailed shape of the clamp 62. The clamp 62 is a leaf spring bent in a V shape. A distal end of one arm **62*a* of the V-shape leaf spring is bent outwardly at a predetermined angle and, as shown in FIG. 4, the distal end is in engagement with the bent portion of the hook 58*c*. A distal end of the other arm 62*b* of the V shape is bent inwardly to constitute an acute-angle locking portion 62*c*. The locking portion 62*c* presses the hook 58*d* toward the circuit board 10 (downwardly), as shown in FIG. 4. The clamp 62 also has a projection 62*d* extending inwardly from the central portion of the arm 62*b*. This projection 62*d* presses the circuit board 10 obliquely upwardly against the heat-radiating head cover 58. Since the circuit board 10 is also pressed upwardly by the distal bent portion of the arm 62*a*, the projection 62*d* serves to chiefly restrict the transverse movement of the circuit board 10**.

Therefore in this embodiment, the movement of the condenser lens row 12 with respect to the heat-radiating head cover 58 is restricted by the clamp 60, the groove and the hook **58*b*. The upward movement and transverse movement of the circuit board 10 are restricted by the arm 62*a* and the projection 62*d*, respectively, so that the circuit board and the head cover can be positioned without using a pin and a through-hole. Thus, the process of production is simplified while guaranteeing precise positioning. Further, even when the circuit board 10 expands due to heat, such expansion can be absorbed by the projection 62*d***.

FIGS. **6*a* through 6*c* are plan, front and bottom views showing the entire construction of the LED head of the third embodiment. In this embodiment, like the first and second embodiments, a circuit board 10 extends longitudinally through the head so as to project beyond opposite ends of the head, and at least one of the projected ends of the circuit board 10 has a hole 44, obtaining the same result. The other projected end of the circuit board 10 has a cutout 64**, which serves to absorb lengthwise dimensional errors.

FIG. 7 shows one end portion of the LED head of the third embodiment. In FIG. 7, reference numeral 66 designates a resin for preventing water or other material from penetrating into the circuit board 10 from its end portion to cause corrosion of circuit elements on the circuit board 10.

According to this invention, it is possible to set the distance between the circuit board and the photosensitive drum accurately by a simple construction. Further, it is possible to simplify the process of production, to set a precise positional relationship between the circuit board and the condenser lens, and to cope with thermal expansion of the circuit board.

What is claimed is:

1. An LED head comprising:

(a) means for emitting light;

(b) a lens for focusing the light from said light-emitting means upon a photosensitive member having surface and two ends; and (c) means for setting a predetermined distance between said light-emitting means and the photosensitive member;

said setting means comprising:

(1) a circuit board supporting said light-emitting means on a surface thereof, said lens being coupled to said circuit board, and (2) means for positioning said photosensitive member, with respect to said light-emitting means, with a light-emitting-means-supporting surface of said circuit board as a reference surface, said means for positioning including a predetermined number of supporting rods each leading from one of the ends of the photosensitive member and having an end directly coupled to the light-emitting-means-supporting surface.

2. An LED head as claimed in claim 1, wherein said light-emitting means comprises a predetermined number of light-emitting diodes.

3. An LED head as claimed in claim 1, wherein said positioning means comprises:

a hole formed in said circuit board; and wherein at least one of said supporting rods comprises a member having a diameter, extending from the photosensitive member and having the first end adapted to be inserted into said hole, said first end having a periphery, a portion of said diameter of said member disposed at said periphery of said first end of said member contacting said circuit board.

4. An LED head as claimed in claim 3, wherein said lens has opposite ends, said circuit board has opposite ends, and said circuit board projects longitudinally beyond said opposite ends of said lens.

5. An LED head as claimed in claim 3, wherein said lens has opposite ends, said circuit board has a first end and a second end which project longitudinally beyond said opposite ends of said lens, said hole is disposed in said first end of said circuit board projecting beyond said lens, and a cutout is formed in said second end of said circuit board projecting beyond said lens.

6. An LED head as claimed in claim 3, said LED head further comprising means for sealing said opposite ends of said circuit board projecting beyond said opposite ends of said lens.

7. An LED head as claimed in claim 1, said LED head further comprising means for removing heat from said light emitting means.

8. An LED head as claimed in claim 1, said LED head further comprising a cover including a window, said cover covering said light-emitting means so that the light emitted from said light-emitting means falls on said lens.

9. An LED head as claimed in claim 8, wherein said cover comprises means to remove heat from said light-emitting means.

10. An LED head comprising:

(a) means for emitting light;

(b) a lens for focusing the light from said light-emitting means upon a photosensitive member having a surface; and (c) means for securing a positional relationship between said light-emitting means and said lens;

said securing means comprising:

(1) a circuit board supporting said light-emitting means on a surface thereof, (2) a cover covering said light-emitting means so that the light emitted from said light-emitting means falls on said lens, and (3) a clamp for clamping said cover against said circuit board, said clamp being substantially V-shaped, so that a positional relationship between said light-emitting means and said lens is secured, wherein said clamp comprises a resilient member comprising a leaf spring bent in a substantially V shaped said leaf spring having a first arm and a second arm, each of said first arm and said second arm of said leaf spring having a bent distal end, said cover having a first hook engageable with said bent distal end of said first arm of said leaf spring, and a second hook against which said bent distal end of said second arm of said leaf spring is to be positioned.

11. An LED head as claimed in claim 10, wherein said light-emitting means comprises a predetermined number of light-emitting diodes.

12. An LED head as claimed in claim 10, said LED head further comprising means for removing heat from said light emitting means.

13. An LED head as claimed in claim 10, wherein said cover comprises a means to remove heat from said light-emitting means.

14. An LED head as claimed in claim 10, wherein said bent distal end of said second arm is further positioned against said circuit head, against said cover, said second arm urging said circuit board.

15. An LED head as claimed in claim 10, wherein one of said first arm and said second arm of said resilient member has a pressing portion for pressing said circuit board against said cover.

16. An LED head as claimed in claim 15, wherein said pressing portion is bent inwardly from said one arm of said resilient member having said pressing portion.

17. An LED head as claimed in claim 10, wherein said cover has a projection extending from the light-emitting-means-supporting surface of said circuit board, and further comprising at least one clip clipping said lens to said projection of said cover.

18. An LED head as claimed in claim 10, wherein said cover has an opening in which said lens is to be received and a hook extending along said opening, said clamp comprising at least one projection to engage with said hook.

19. An LED head comprising:

(a) means for emitting light;

(b) a lens for focusing the light from said light-emitting means upon a photosensitive member having a surface and two ends;

(c) a circuit board supporting said light-emitting means on a surface thereof, said lens being coupled to said circuit board;

(d) a cover covering said light-emitting meads so that the light emitting means falls on said lens;

(e) means for positioning said photosensitive member, with respect to said light-emitting means, with a light-emitting-means-supporting surface of said circuit board as a reference surface, said means for positioning including a predetermined number of supporting rods each leading from one of the ends of the photosensitive member and having an end directly coupled to the light-emitting-means-supporting surface; and (f) a clamp for clamping said cover against said circuit board, said clamp having a substantially V-shape.

20. An LED printer comprising:

an LED head, said LED head comprising:

(a) means for emitting light to print dots;

(b) a photosensitive member having a surface and two ends;

(c) a lens for focusing the light from said light-emitting means upon said surface of said photosensitive member; and (d) means for setting a predetermined distance between said light-emitting means and said photosensitive member; said setting means comprising:

(1) a circuit board supporting of said light-emitting means on a surface thereof, said lens being coupled to said circuit board, and (2) means for positioning said photosensitive member, with respect to said light-emitting means, with a light-emitting-means-supporting surface of said circuit board as a reference surface, said means for positioning including a predetermined number of supporting rods each leading from one of the ends of the photosensitive member and having an end directly coupled to the light-emitting-means-supporting surface.

21. An LED printer comprising:

a photosensitive member having a surface; and an LED head, said LED head comprising:

(a) means for emitting light to print dots constituting characters or the like;

(b) a lens for focusing the light from said light-emitting means upon said surface of said photosensitive member; and (c) means for securing a positional relationship between said light-emitting means and said lens;

(d) said securing means comprising:

(1) a circuit board supporting said light-emitting means on a surface thereof, (2) a cover covering said light-emitting means so that the light emitted from said light-emitting means falls on said lens, and (3) a clamp for clamping said cover against said circuit, said clamp being substantially V-shaped, so that a positional relationship between said light-emitting means and said lens is secured, wherein said clamp comprises a leaf spring bent in a substantially V shape, said leaf spring having a first arm and a second arm, each of said first arm and said second arm of said leaf spring having a bent distal end of said cover having a first hook engageable with said bent distal end of said first arm of said leaf spring, and a second hook against which said bent distal end of said second arm of said resilient member is to be positioned.

22. An LED printer comprising:

a photosensitive member having a surface and two ends; and an LED head, said LED head comprising:

(a) means for emitting light to print dots constituting characters or the like;

(b) a lens for focusing the light from said light-emitting means upon said surface of said photosensitive member;

(c) a circuit board supporting said light-emitting means on a surface member, said lens being coupled to said circuit board;

(d) a cover covering said light-emitting means so that the light emitted from said light-emitting means falls on said lens;

(e) means for positioning said photosensitive member, with respect to said light-emitting means, with a light-emitting-means-supporting surface of said circuit board as a reference surface, said means for positioning including a predetermined number of supporting rods each leading from one of the ends of the photosensitive member and having an end directly coupled to the light-emitting-means-supporting surface; and (f) a clamp for clamping said cover against said circuit board, said clamp having a substantially V-shape.

23. A mechanism for setting a predetermined distance between a light-emitting means and a photosensitive member which has two ends, said mechanism comprising:

(a) a circuit board supporting the light-emitting means on a surface thereof said lens being coupled to said circuit board; and (b) means for positioning said photosensitive member, with respect to said light-emitting means, with a light-emitting-means-supporting surface of said circuit board as a reference surface, said means for positioning including a predetermined number of supporting rods each leading from the of the ends of the photosensitive member and having an end directly coupled to a light-emitting-means-supporting surface.

24. A mechanism for setting a predetermined distance between a light-emitting means and a photosensitive member and for securing a positional relationship between said light-emitting means and a lens, said mechanism comprising:

(a) a circuit board supporting said light-emitting means on a surface thereof;

(b) a cover covering said light-emitting means so that the light emitted from said light-emitting means falls on said lens; and (c) a clamp for clamping said cover against said circuit board, said clamp being substantially V-shaped, wherein said clamp comprises a leaf spring bent in a substantially V shape, said leaf spring having a first arm and a second arm, each of said first arm and said second arm of said leaf spring having a bent distal end, said cover having a first hook engageable with said bent distal end of said first arm of said leaf spring, and a second hook against which said bent distal end of said second arm of said leaf spring is to be positioned.

25. A mechanism for setting a predetermined distance between a light-emitting means and a photosensitive member and for securing a positional relationship between said light-emitting means and a lens, said mechanism comprising:

(a) a circuit board supporting said light-emitting means on a surface thereof;

(b) means for positioning said photosensitive member, with respect to said light-emitting means, with a light-emitting-means-supporting surface of said circuit board as a reference surface;

(c) a cover covering said light-emitting means so that the light emitted from said light-emitting means falls on said lens; and (d) a clamp for clamping said cover against said circuit board, said clamp having a substantially V-shape, wherein said clamp comprises a leaf spring bent in a substantially V shade, said leaf spring having a first arm and a second arm, each of said first arm and said second arm of said leaf spring having a bent distal end, said cover having a first hook engageable with said bent distal end of said first arm of said leaf spring, and a second hook against which said bent distal end of said second arm of said leaf spring is to be positioned.

* * * * *